United States Patent [19]

Robinson

[11] 4,069,699

[45] Jan. 24, 1978

[54] APPARATUS FOR STABILIZING STRUCTURAL STUDS

[76] Inventor: David M. Robinson, 6710 NW. 8th St., Margate, Fla. 33063

[21] Appl. No.: 670,435

[22] Filed: Mar. 25, 1976

[51] Int. Cl.[2] ..... B21D 31/02

[52] U.S. Cl. ..... 72/325; 29/509; 29/515; 29/243.5; 29/283.5; 113/1 N

[58] Field of Search ..... 29/509, 515, 243.5, 29/283.5; 113/1 N; 72/325

[56] References Cited

U.S. PATENT DOCUMENTS

| | | | |
|---|---|---|---|
| 2,603,856 | 7/1952 | Nelson | 113/1 N X |
| 2,994,127 | 8/1961 | Switzer | 29/283.5 X |
| 3,081,537 | 3/1963 | Novy et al. | 113/1 N X |
| 3,411,339 | 11/1968 | Brown | 72/325 X |
| 3,470,572 | 10/1969 | Wasserman | 29/509 X |
| 3,624,876 | 12/1971 | Irvin | 29/243.5 X |
| 3,797,194 | 3/1974 | Ekstein | 29/509 X |
| 3,925,875 | 12/1975 | Doke | 29/509 |

*Primary Examiner*—Charlie T. Moon
*Attorney, Agent, or Firm*—Malin & Haley

[57] ABSTRACT

A non-load bearing, structural stud which has been positioned in a track, may be stabilized in that position in the track by a method of simultaneously making an incision in one wall of the track adjacent both corners of the stud which abut the wall, and curling that portion of the sidewall which lies between the individual incisions and the structural stud, toward the stud and into securing contact therewith. The stud stabilizing apparatus comprises a pair of knife edge means, rigidly held by a center post in parallel, spaced relationship.

6 Claims, 7 Drawing Figures

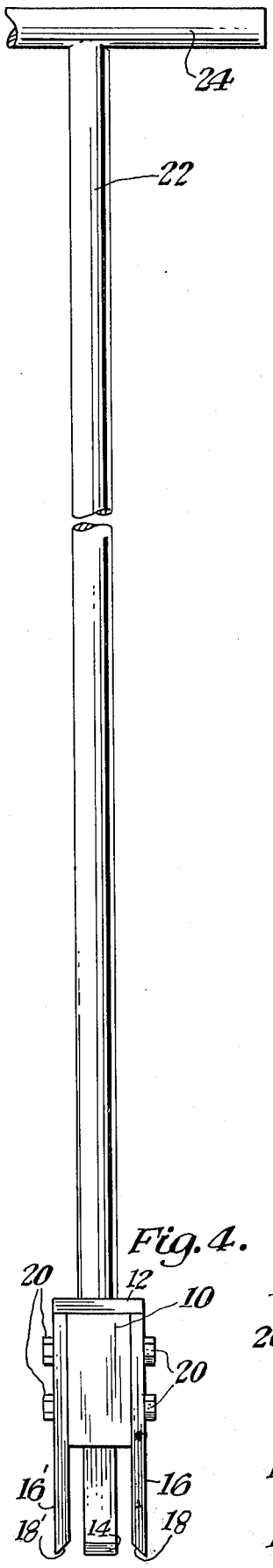
Fig.4.
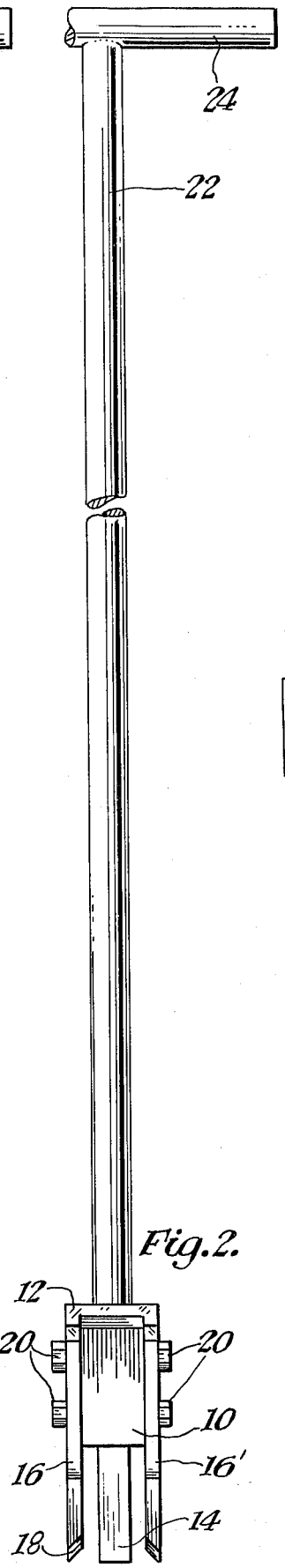
Fig.2.
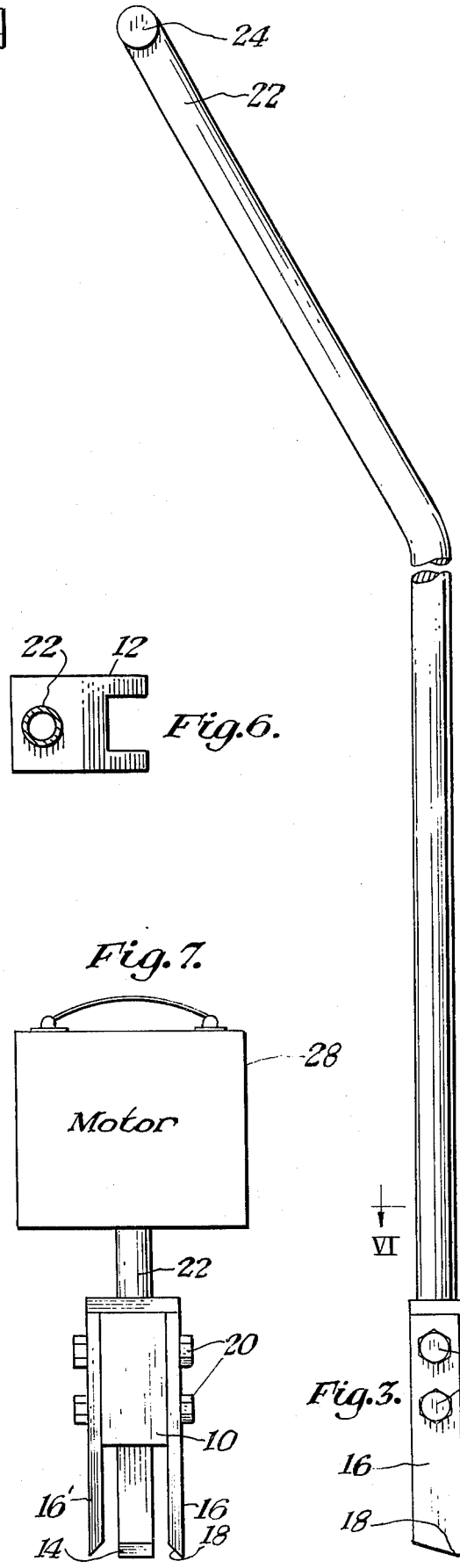
Fig.6.
Fig.7.
Fig.3.

APPARATUS FOR STABILIZING STRUCTURAL STUDS

BACKGROUND OF THE INVENTION

This invention relates to the construction industry generally, and, specifically, to the construction of semi-permanent walls using non-load bearing, structural studs.

It is common practice in modern office buildings to construct each floor of such buildings with few, or no, permanent interior walls. Instead, temporary walls are installed in accordance with the particular requirements of each tenant in the building. By so doing, space utilization is maximized since each individual tenant need lease only so much space as is necessary for his particular enterprise.

The conventional method of constructing temporary walls is to secure traugh-shaped, or U-shaped, tracks to the ceiling and to the floor along the lines of the desired wall. A structural stud having approximately the same width as the track, and having a length approximately equal to the distance between floor and ceiling, is placed in the track perpendicular to the floor and ceiling. The stud is then secured in this position in the track by implacing a screw through the side wall of the track and into the stud at each point where the track sidewall abutts the stud. The walls of the U-shaped track thus lie in juxtaposition over a portion of the stud. In like manner, several studs are positioned in the track. With the structural framework thus constructed, rectangular sections of dry wall, or the like, are then erected and secured to the several studs, thereby forming a wall. A multiplicity of such walls may be constructed which segregate the floor of the building into individual rooms, all as is well known to those skilled in the art.

While the conventional method of securing the stud to the track, i.e., with the use of screws, results in a satisfactorily stable arrangement, the implacement of screws is costly, due to not only equipment and materials, but also to the man-hours necessary to carry out the operation. In addition, removal of the screws during a dismantling operation is extremely time consuming. There exists, therefore, a need for a less complex, more economical method of stabilizing semi-permanent, non-load bearing, structural studs, which avoids the use of screws and the like.

SUMMARY

It has now been discovered that non-load bearing, structural studs may be stabilized in a desired position in a track by a process which makes two incisions in one of the walls of the track, one incision being closely adjacent to each of the two corners of the stud which abut that wall, and then bending or curling that portion of the wall, which lies between each incision and the associated corner of the stud, towards the stud until it comes into securing contact with the stud. The process may be repeated on the juxtaposed trackwall for additional stability. It has also been discovered that this method of stabilizing studs may be accomplished by the use of an apparatus having two parallel sides, the lower edges of which form inwardly tapering knife edges, which sides are held parallel to each other, and at a distance from each other of not less than the width of the stud, by a center post between the sidewalls.

BRIEF DESCRIPTION OF THE DRAWINGS

FIG. 2 is a front view of a preferred embodiment of our invention.

FIG. 3 is a side view of a preferred embodiment of our invention.

FIG. 4 is a rear view of a preferred embodiment of our invention.

FIG. 6 is a cross-section taken along the line V—V of FIG. 2 and looking in the direction of the arrows.

FIG. 7 is a rear view of an alternative embodiment of our invention.

DESCRIPTION OF THE PREFERRED EMBODIMENT

A complete understanding of my invention will be gained by those skilled in the art from the following description with reference to the drawings.

Figure 1:
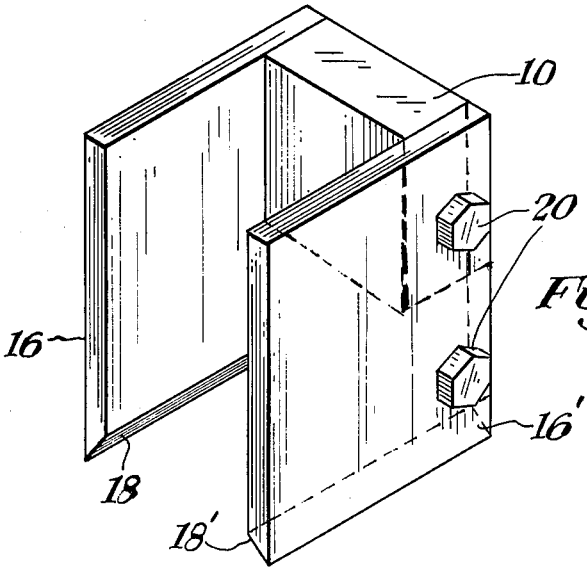
FIG. 1 is a perspective view of the invention in its broadest sense.

FIG. 1 shows one embodiment of our invention, comprising two parallel sidewalls 16 and 16', a center post, 10, and securing means, 20, such screws or the like, holding the sidewalls to the center post. Alternatively, sidewalls 16 and 16' and center post 10 may be a single piece, or may be welded together, thereby eliminating securing means 20. The sidewalls 16 and 16' have lower edges 18 and 18' respectively, which are sharpened to form inwardly tapering knife edges. The center post 10 has a width of not less than that of a structural stud and not greater than the sum of the stud width plus twice the height of the walls of the U-shaped track in which the stud is to be emplaced. In addition, it is preferable to maintain the vertical distance between knife edges 18 and 18' and the bottom of center post 10 at not less than the height of the walls of the U-shaped trough. Finally, we prefer that the horizontal distance between the front edge of knife edges 18 and 18' and the plane of the forward side of center post 10 be not greater than the depth of the stud.

FIGS. 2–4 show a preferred embodiment of our invention in which a U-shaped upper guide means, 12, having an interior distance between its extending sides not less than the stud width, is secured to the top of the apparatus and a lower guide post 14 extends downwardly from center post 10. In addition, knife edges 18 and 18' are beveled in such a way that the portion extending beyond the forward side of center post 10 is angled upwards. Also, rather than being rectangular, sidewalls 16 and 16' may perferably be L-shaped as shown in FIG. 3. so as to allow the operator to observe the stud more fully.

Finally, the apparatus may be equipped with shaft, 22, having handle, 26, in order that its use in the method of stud stabilization, described further below, may be more convenient.

Figure 5:
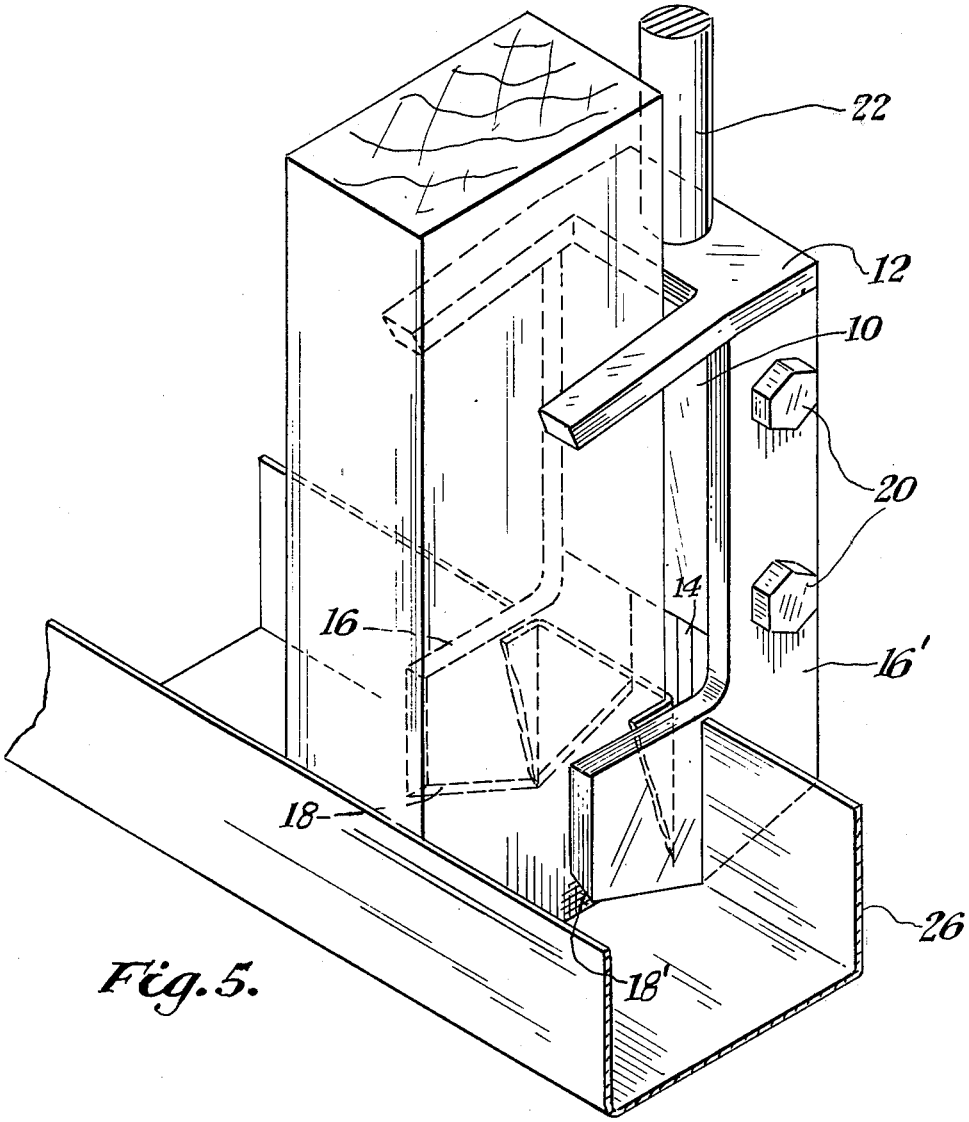
FIG. 5 is a perspective view of a preferred embodiment of our invention in operation.

FIG. 5 is a perspective view of our apparatus in operation and shows the preferred form of our method of stabilizing structural studs. As is therein depicted, a stud is placed in its U-shaped trough or track in the desired location. The apparatus is placed adjacent the stud, with upper guide means 12 engaging the stud and lower guide post 14 resting against the stud. Sidewalls 16 and 16' and knife edges 18 and 18' extend over the track walls, 26.

A motive force is then applied in a downward direction, causing the apparatus to descend generally along the path defined by the stud. Where knife edges 18 and 18' contact walls 26, an incision is made therein the depth of which increases as the apparatus descends. The outer side of the knife edges, being planar, allows the portion of the track wall adjacent thereto to remain generally upright. However, the portion of the track wall adjacent the inner side of the knife edges, and between these knife edges and the stud, is curled away from the knife edge and toward the stud because of the inward taper of the knife edge. As the depth of the incision increases, the size of that portion of the wall which is curled toward the stud will increase until it contacts the stud. Since this curling action has taken place on both sides of the stud simultaneously, the curled wall comes into securing contact with both sides of the stud thereby stabilizing it in the desired position.

This method may be repeated on the opposite side of the stud in order to have curled portions of the track wall in securing contact with the stud at four points.

In addition to the manually operated apparatus described above, FIG. 7 is a side view of an embodiment of our apparatus mounted on a reciprocating motor, 28, such as a solenoid coil device, or, alternatively, on a spring triggering mechanism, in order that the downward motive force applied during the curling operation may be electrical or mechanical rather than manual.

While we have described our method of stabilizing studs with reference to our apparatus, it should be noted that the essential novelty of our method resides in the making of incisions in a track wall adjacent both sides of the stud and the subsequent simultaneous curling of that portion of the wall between the incision and the stud toward the stud and into securing contact therewith. Such being the case, the scope of our method of stabilizing structural studs should not be limited to the use of our apparatus.

The instant invention has been shown and described herein in what is considered to be the most practical and preferred embodiment. It is recognized, however, that departures may be made therefrom within the scope of the invention and that obvious modifications will occur to a person skilled in the art.

I claim:

1. An apparatus for stabilizing structural studs in a track, which track has two lateral walls and a bottom, comprising:

a first sidewall having one side of its lower edge beveled to form a first knife edge, a second sidewall having the opposite side of its lower edge beveled to form a second knife edge, and a center post for holding said first sidewall and said second sidewall parallel to each other and at a distance from each other of not greater than the sum of the width of said stud plus twice the thickness of said trackwalls, such that the beveled lower edges of said sidewalls form inwardly tapering knife edges to cut and bend of the track lateral wall against opposite sides of the stud and into securing contact therewith.

2. The apparatus of claim 1 wherein the distance between said knife edges and the bottom of said center post is not less than the height of the walls of said track.

3. The apparatus of claim 2 wherein said center post is spaced from a forward edge of each knife edge by a distance of not less than the depth of the stud.

4. The apparatus of claim 3 wherein said knife edges angle upwards from the approximate midpoint thereof to the forward edge thereof.

5. The apparatus of claim 4 further comprising handle means securingly attached to the top of the center post for holding said apparatus during operation.

6. The apparatus of claim 4 further comprising reciprocating motor means for exerting a pulsed motive force along a shaft and a shaft means for connecting said motor to said apparatus, so constructed and arranged that the actuation of said motor means may exert a pulsed motive force along said shaft and displace said sidewalls and said center post in a downward position.

* * * * *